United States Patent [19]

Kaszuba

[11] 4,037,901

[45] July 26, 1977

[54] ELECTRICAL SAFETY SOCKET

[76] Inventor: Edward H. Kaszuba, 300 Winston Drive, Cliffside Park, N.J. 07010

[21] Appl. No.: 681,331

[22] Filed: Apr. 28, 1976

[51] Int. Cl.[2] ..... H01R 13/44

[52] U.S. Cl. ..... 339/41

[58] Field of Search ..... 339/36, 40, 41, 42, 339/88

[56] References Cited

FOREIGN PATENT DOCUMENTS 696,549 10/1964 Canada ..... 339/41

*Primary Examiner*—Roy Lake

*Assistant Examiner*—Neil Abrams

*Attorney, Agent, or Firm*—Allen D. Brufsky

[57] ABSTRACT

An electrical safety socket in which there is no electrical contact between the socket and a plug inserted in the socket unless the plug is properly inserted in the socket, pushed in, and turned. The plug, once inserted in the socket, cannot be removed unless the reverse sequence of operations are performed. This precludes electrical contact if a child should insert a foreign metal object in the socket when the plug has been removed, or prevents the plug from being removed from the socket once inserted.

9 Claims, 6 Drawing Figures

ELECTRICAL SAFETY SOCKET

BACKGROUND OF THE INVENTION

This invention relates to an electrical socket element, and more particularly, an electrical socket element for receiving an electrical plug which requires several coordinated movements of the plug to establish an electrical connection between the plug and socket.

It is well-known that young children tend to place pins, other foreign objects or even their fingers in electrical outlets. In order to overcome this hazard, the present invention provides an electrical socket or wall-mounted electrical receptacle which cannot establish electrical contact with an object placed into the socket, unless the object is inserted into the socket, the socket pushed in, and the object rotated along with the socket. These movements can easily be performed by an adult, but cannot be easily mastered by young children.

SUMMARY OF THE INVENTION

In accordance with the invention, the socket or plug receptacle includes a housing and a freely rotatable socket element in the housing. Spaced from the rotatable socket element by a coil spring within the housing is an axially slideable and rotatable plate. The plate and rotatable socket element include mating U-shaped protrusions and grooves which are normally separated. The plug is inserted through the plate and into the socket element wherein the prongs of the plug are gripped along mating surfaces with a pair of electrical contact elements. By pushing the plug axially into the socket, the plate is moved axially against the force of the coil spring. As the plug is pushed in, it is rotated until the mating U-shaped protrusions and grooves on the plate and socket element engage, which enable the socket element to be rotated with the plate until the contact elements in the socket are placed in electrical contact with the leads of power wires to cause current to flow through the prongs of the plug.

In order to insert the plug into the socket housing, a pair of tabs on the plug must be pushed through entrance openings in the housing. As the plug is rotated to make the electrical connection, the interior of the housing overlying the plug tabs prevents the plug from being removed from the housing. Therefore, to remove the plug, the reverse sequence of operation is required so that when the plug is removed, electrical power to the socket is disconnected. If a child were then to insert a foreign object into the socket, contact with the source of electrical power has been removed and if the plug is in the socket, a child cannot remove it without disconnecting the power to the socket, or perhaps more importantly, the child cannot remove the plug at all without substantial effort.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 1:
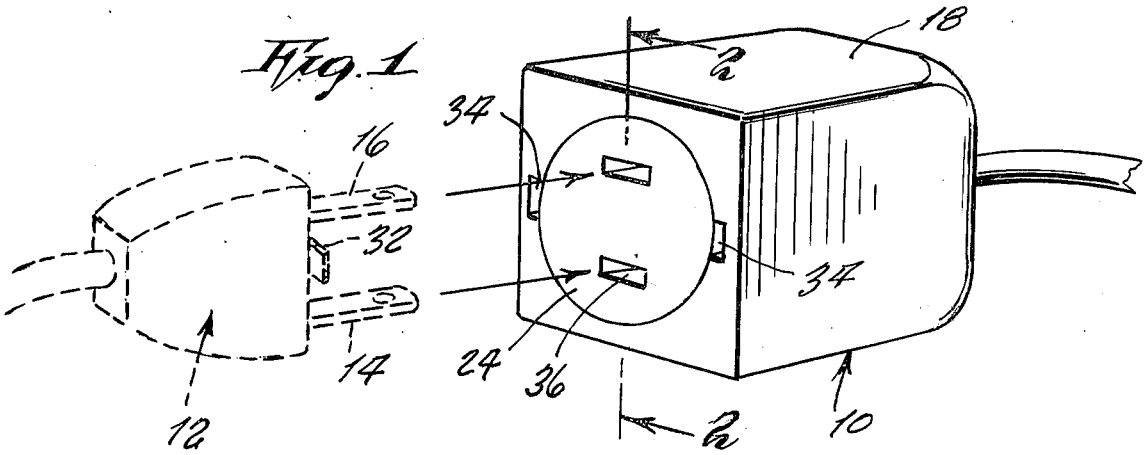
FIG. 1 is a perspective view of an electrical plug and socket of the present invention.
Figure 2:
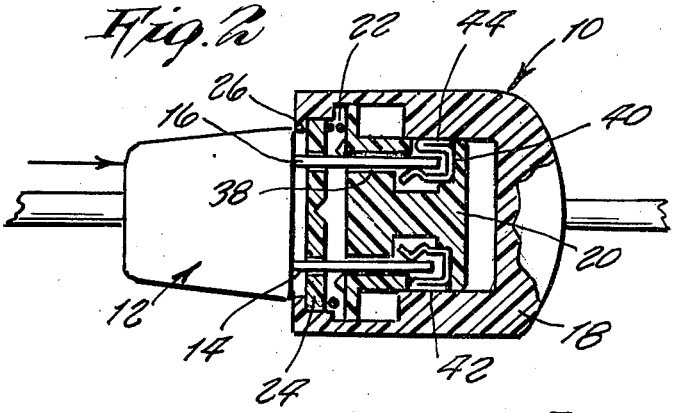
FIG. 2 is a cross-sectional view of the socket taken substantially along the plane indicated by line 2—2 of FIG. 1 and also illustrating the plug initially inserted into the socket.
Figure 6:
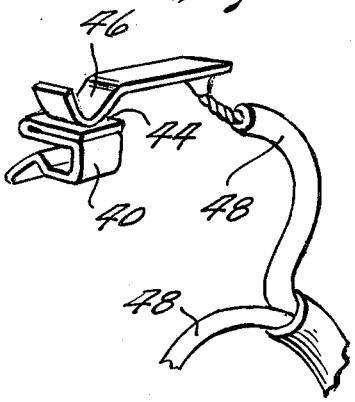
FIG. 6 is a perspective view of the engagement between the power wires and socket element contacts.
Figure 3:
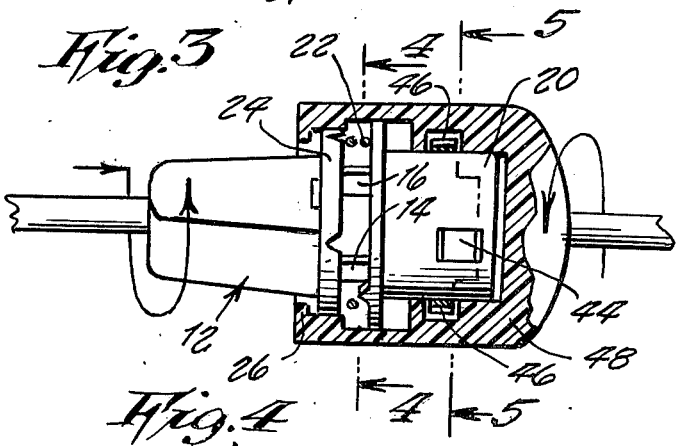
FIG. 3 is a view similar to FIG. 2, but with the plug pushed in and the plug and socket partly rotated.
Figure 4:
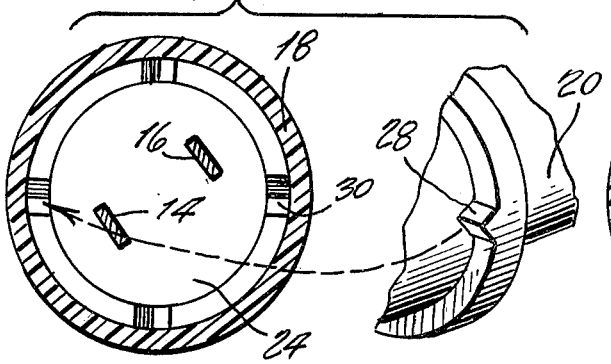
FIG. 4 is a cross-sectional view taken substantially along the plane indicated by line 4—4 of FIG. 3 and illustrates U-shaped grooves on the axially slideable socket plate which are adapted to mate with complementally shaped protrusions on the rotatable socket element shown partially in perspective.

Referring now to the drawing in detail, wherein like numerals indicate like elements throughout the several views, FIG. 1 illustrates an electrical safety socket 10 of the present invention, which can be an extension cord socket or wall-mounted receptacle to receive the prongs 14, 16 of an electrical plug 12.

Socket 10 includes a housing 18 and a freely rotatable, substantially cylindrical, socket element 20 in housing 18. Spaced from the rotatable socket element 20 by a coil spring 22 within housing 18 is an axially slideable and rotatable cylindrical plate 24. Plate 24 is retained within housing 18 by abatement with an annular lip 26 defining the entrance into housing 18.

Plate 24 and socket element 20 include mating U-shaped protrusions 28 (on socket element 20) and grooves 30 (on plate 24) about their circumference which are normally separated by coil spring 22.

Plug 12 includes a pair of laterally extending tabs 32, which when plug 12 is inserted into socket 10, must pass through complementally shaped passages 34 in annular lip 26. Plug 12 is inserted into socket element 20 in order to make an electrical connection by inserting prongs 14 and 16 through holes 36 in plate 24 after tabs 32 are aligned with passages 34. Prongs 14 and 16 traverse the space between plate 24 and socket element 20 and are inserted through an annular groove 38 in socket element 20 until they are gripped by a pair of electrical contact elements 40 and 42 fixed in the rear of socket element 20.

Contact elements 40 and 42 are substantially U-shaped and include a portion 44 bent back on itself which is exposed to the exterior of socket element 20.

By pushing plug 12 axially into socket housing 18, plate 24 is moved by abutment with plug 12 axially against the force of coil spring 22. As the plug is pushed in, it is also rotated until the mating U-shaped protrusions 28 and grooves 30 on the socket element 20 and plate 24, respectively, engage which enables the socket element 20 to be rotated with plate 24 until the exterior portions 44 of contact elements 40 and 42 in socket element 20 are placed in electrical contact with the leads 46 of power wire 48 to cause current to flow through the prongs 14, 16 of plug 12.

Figure 5:
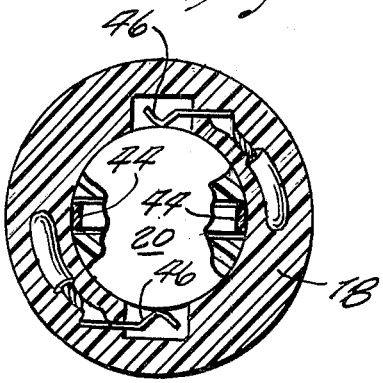
FIG. 5 is a cross-sectional view taken substantially along the plane indicated by line 5—5 of FIG. 3, showing the socket element contacts disengaged from the power wires.

Lip 26 in abutment with tabs 32 will prevent plug 12, after it is rotated to its power receiving positioning, from being pulled out of socket element 20. Therefore, to remove plug 12, the plug 12 must be pushed in and rotated first in a reverse direction to align tabs 32 with passages 34 in lip 26. This automatically disconnects contacts 40 and 42 from engagement (as in FIG. 5) with power leads 46, so that when plug 12 is removed, the source of power is disconnected from socket element 20. If a foreign object is subsequently put in socket element 20 through holes 36 in plate 24 electric current will not be available.

I claim:

1. An electrical safety socket comprising:

a housing, a rotatable socket element within said housing adapted to axially receive the contact prongs of an electrical plug, a pair of electrical contact elements fixed to said rotatable socket element, a pair of stationary electrical contact elements in said housing adapted to be connected to a source of electrical power, and rotation means in said housing operatively axially movable relative to said socket in response to the axial insertion of the prongs of said electrical plug into said socket element and into electrical contact with said contact elements fixed to said socket element for engaging with and rotating said socket element to a position electrically connecting said socket contact elements with said stationary contact elements.

2. An electrical safety socket in accordance with claim 1 wherein said rotation means includes an axially slideable and rotatable plate within said housing, engagement means on said plate and socket element, and spring means between said plate and socket element normally urging said engagement means on said plate and socket element away from each other.

3. An electrical safety socket in accordance with claim 2 wherein said engagement means includes mating U-shaped protrusions and grooves.

4. An electrical safety socket in accordance with claim 2 including an annular lip on said housing in abutment with said plate for retaining said plate within said housing.

5. An electrical safety socket in accordance with Claim 2 wherein said socket element includes an annular groove receiving the prongs of said plug.

6. An electrical safety socket in accordance with claim 1 wherein said means for rotating said socket element is axially slideable and rotatable within said housing.

7. An electrical safety socket in accordance with claim 1 including means within said housing for preventing removal of the plug inserted into said housing after said socket contact elements are rotated into electrical contact with said stationary contact elements.

8. An electrical safety socket in accordance with claim 1 wherein a portion of said contact elements fixed to said socket element extends exteriorly of said socket element.

9. An electrical safety connection comprising:

a socket including a housing, a rotatable socket element within said housing having an annular groove for receiving the prongs of an electrical plug, a pair of electrical contact elements fixed to said rotatable socket element, each of said contact elements including a portion extending exteriorly of said socket element and a portion within said socket element for engagement with the prongs of said plug inserted into the annular groove in said socket element, a pair of stationary electrical contact elements in said housing adapted to be connected to a source of electrical power and the exterior portions of said contact elements fixed to said socket, means for rotating said socket element to a position electrically connecting the exterior portions of said socket contact elements to said stationary contact elements, said rotation means including an axially slideable and rotatable plate within said housing, engagement means on said plate and socket element, and spring means between said plate and socket element normally urging said engagement means on said plate and socket element away from each other, an electrical plug having laterally extending tabs thereon and a pair of spaced electrical prongs insertable into said socket through said plate and groove in said socket element into mating engagement with the interior portions of the electrical contact elements fixed to said socket, and an annular lip on said housing in abutment with said plate having passages enabling said plug and the tabs therein to pass into said housing to push said plate axially to engage and upon rotation of said plug to rotate said socket element so that said socket contact elements are placed in electrical contact with said fixed electrical contacts, said lip preventing removal of said rotated plug by abutment with said tabs.

* * * * *